US007829840B2

(12) United States Patent
Nakajima

(10) Patent No.: US 7,829,840 B2
(45) Date of Patent: Nov. 9, 2010

(54) DEVELOPING UNIT, PROCESS CARTRIDGE, AND IMAGE FORMING DEVICE

(75) Inventor: Keigo Nakajima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 431 days.

(21) Appl. No.: 12/024,452

(22) Filed: Feb. 1, 2008

(65) Prior Publication Data

US 2008/0199222 A1 Aug. 21, 2008

(30) Foreign Application Priority Data

Feb. 20, 2007 (JP) ..... 2007-039566

(51) Int. Cl.
*G03G 15/08* (2006.01)

(52) U.S. Cl. ..... 250/254

(58) Field of Classification Search ..... 399/254, 399/256, 258; 366/279, 318, 325.1; 222/240, 222/241

See application file for complete search history.

(56) References Cited

U.S. PATENT DOCUMENTS 3,975,469 A * 8/1976 Fuchs ..... 261/87
4,025,179 A * 5/1977 Hudson ..... 399/254
4,318,607 A * 3/1982 Bonham et al. ..... 399/277
4,559,898 A * 12/1985 Fukuchi et al. ..... 399/254
4,723,143 A * 2/1988 Enomoto ..... 399/254
4,974,023 A * 11/1990 Aimoto et al. ..... 399/119
5,239,346 A * 8/1993 Corbin et al. ..... 399/254
5,249,019 A * 9/1993 Ishida et al. ..... 366/318
5,655,195 A 8/1997 Ichikawa et al.
5,666,618 A * 9/1997 Lee et al. ..... 399/254
6,047,141 A * 4/2000 Miyaoka et al. ..... 399/27
6,337,956 B1 1/2002 Sato et al.
6,360,066 B1 * 3/2002 Kawahito et al. ..... 399/254
6,415,126 B2 7/2002 Matsatoshi et al.
6,456,810 B1 * 9/2002 Deguchi et al. ..... 399/254
6,459,876 B1 * 10/2002 Buchanan et al. ..... 399/254
6,501,933 B2 * 12/2002 Ishii ..... 399/254
7,346,297 B2 * 3/2008 Kawakami et al. ..... 399/254
7,346,298 B2 * 3/2008 Yamaguchi et al. ..... 399/256
7,391,998 B2 * 6/2008 Aoki et al. ..... 399/254
7,509,081 B2 * 3/2009 Bessette ..... 399/263
2002/0197085 A1 * 12/2002 Sugita et al. ..... 399/258
2005/0100367 A1 * 5/2005 Uratani et al. ..... 399/254
2005/0111883 A1 * 5/2005 Amano et al. ..... 399/254
2005/0123321 A1 * 6/2005 Buhay-Kettelkamp et al. ... 399/254
2005/0163536 A1 * 7/2005 Miller ..... 399/254
2005/0207793 A1 * 9/2005 Ikeda et al. ..... 399/254
2006/0171743 A1 * 8/2006 Mori et al. ..... 399/252

(Continued)

FOREIGN PATENT DOCUMENTS

JP 63-008756 1/1988

(Continued)

*Primary Examiner*—David P Porta
*Assistant Examiner*—Kiho Kim
(74) *Attorney, Agent, or Firm*—Banner & Witcoff, Ltd.

(57) ABSTRACT

A developing unit includes a developer agitating member having a plurality of vanes that are disposed in a developer containing chamber and that are rotatable about an axis parallel to an axis of a supply roller. Each of the vanes has a peripheral edge, and a trailing end of the peripheral edge in a vane rotation direction is located more inside than a leading end of the peripheral edge.

19 Claims, 9 Drawing Sheets

U.S. PATENT DOCUMENTS

| | | | | |
|---|---|---|---|---|
| 2006/0182467 | A1* | 8/2006 | Aoki et al. | 399/254 |
| 2006/0239718 | A1* | 10/2006 | Deguchi et al. | 399/254 |
| 2007/0019994 | A1* | 1/2007 | Choi | 399/254 |
| 2007/0031168 | A1* | 2/2007 | Koyama | 399/254 |
| 2007/0048024 | A1* | 3/2007 | Choi et al. | 399/254 |
| 2007/0140743 | A1* | 6/2007 | Kamimura | 399/254 |

FOREIGN PATENT DOCUMENTS

| | | | |
|---|---|---|---|
| JP | 1-276173 | A | 11/1989 |
| JP | 4-093868 | A | 3/1992 |
| JP | 8-006394 | A | 1/1996 |
| JP | 09-043987 | | 2/1997 |
| JP | 11-338240 | | 12/1999 |
| JP | 2001-005276 | | 1/2001 |
| JP | 2001-166574 | A | 6/2001 |
| JP | 2001-194882 | A | 7/2001 |
| JP | 2005-070702 | A | 3/2005 |
| JP | 2006-220698 | A | 8/2006 |

* cited by examiner

FIG. 7 (a)
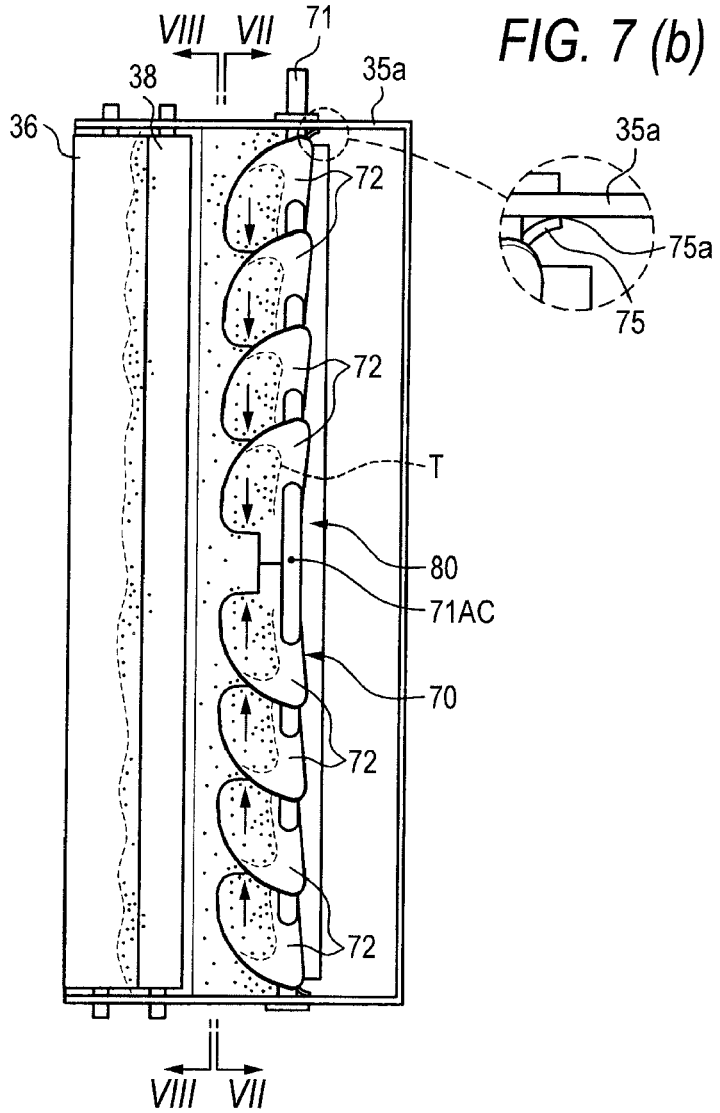
FIG. 7 (b)
FIG. 7 (c)
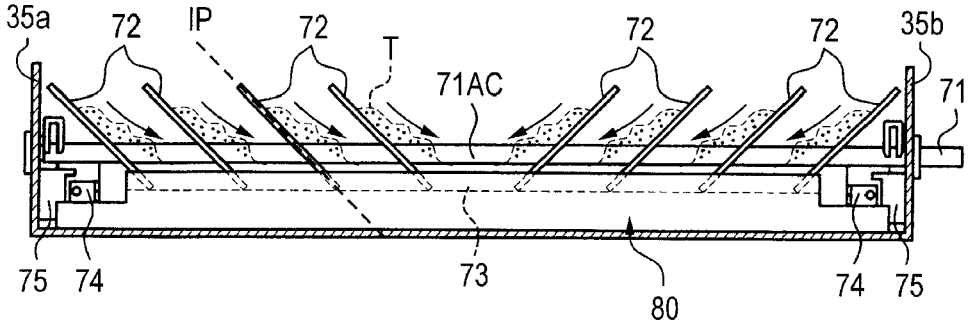

DEVELOPING UNIT, PROCESS CARTRIDGE, AND IMAGE FORMING DEVICE

CROSS REFERENCE TO RELATED APPLICATION

The present disclosure relates to the subject matter contained in Japanese patent application No. 2007-039566 filed on Feb. 20, 2007, which is expressly incorporated herein by reference in its entirety.

TECHNICAL FIELD

The present invention relates to a developing unit, a process cartridge, and an image forming device.

BACKGROUND ART

In general, an image forming device using a toner employs an agitator to prevent the toner in a container from becoming cohesively bulky.

Japanese Unexamined Utility Model Application Publication No. Sho. 63-8756-A shows an example of the agitator. The agitator includes plural agitating plates (5-5) fixed to a rotation shaft (5-4) to form a constant angle with respect to the rotation shaft, and agitating shafts (5-6, 5-7) extending parallel to the rotation shaft and connecting one ends of the agitating plates. The agitator uses the agitating plates and the agitating shafts in an attempt to uniformly agitate a toner such that the toner collected along the agitating plates is scooped up by the agitating shafts.

However, since the plural agitating plates are tilted by the same angle in the same direction with respect to the rotation shaft, the rotation of the rotation shaft causes the agitating plates to convey the toner to one end of the rotation shaft, and thus the toner is likely to stay at the one end. Further, the agitating shafts can agitate a part of the toner sliding off from the agitating plates and gathering at a bottom of a toner containing chamber along the shapes of the agitating plates when the agitating shaft passes through the part of the toner, but the agitating shafts are difficult to agitate another part of the toner in the vicinity of the bottom to cause the stay of the toner. The stay of the toner is a notable disadvantage particularly when an amount of toner in the toner containing chamber is small.

The stay of the toner causes an image to be unclear, or causes the blur that the toner is loaded to an undesired portion.

SUMMARY

The present invention can provide, as one of illustrative, non-limiting embodiment, a developing unit which includes a developer agitating member having a plurality of vanes that are disposed in a developer containing chamber and that are rotatable about an axis parallel to an axis of a supply roller. Each of the vanes has an peripheral edge, and a trailing end of the peripheral edge in a vane rotation direction is located more inside than a leading end of the peripheral edge.

Accordingly, as one of advantages of the present invention, a toner can be prevented from staying in the toner containing chamber. As another one of the advantages, the toner can be agitated well even when an amount of remaining toner is small.

These and other advantages of the present invention will be discussed in detail with reference to the accompanying drawings.

BRIEF DESCRIPTION OF THE DRAWINGS

FIG. 7(*a*) is a cross-sectional view taken along Line A-A of FIG. 2, which shows a flow of the toner in the state shown in FIG. 6(*b*), FIG. 7(*b*) is an enlarged diagram of a wiper, and FIG. 7(*c*) is a cross-sectional view taken along Line VII-VII of FIG. 7(*a*).

DESCRIPTION OF THE PREFERRED EMBODIMENT

Illustrative, non-limiting embodiments of the present invention will be described in detail with reference to a laser printer shown in the accompanying drawings.

<Entire Configuration of Laser Printer>

Figure 1:
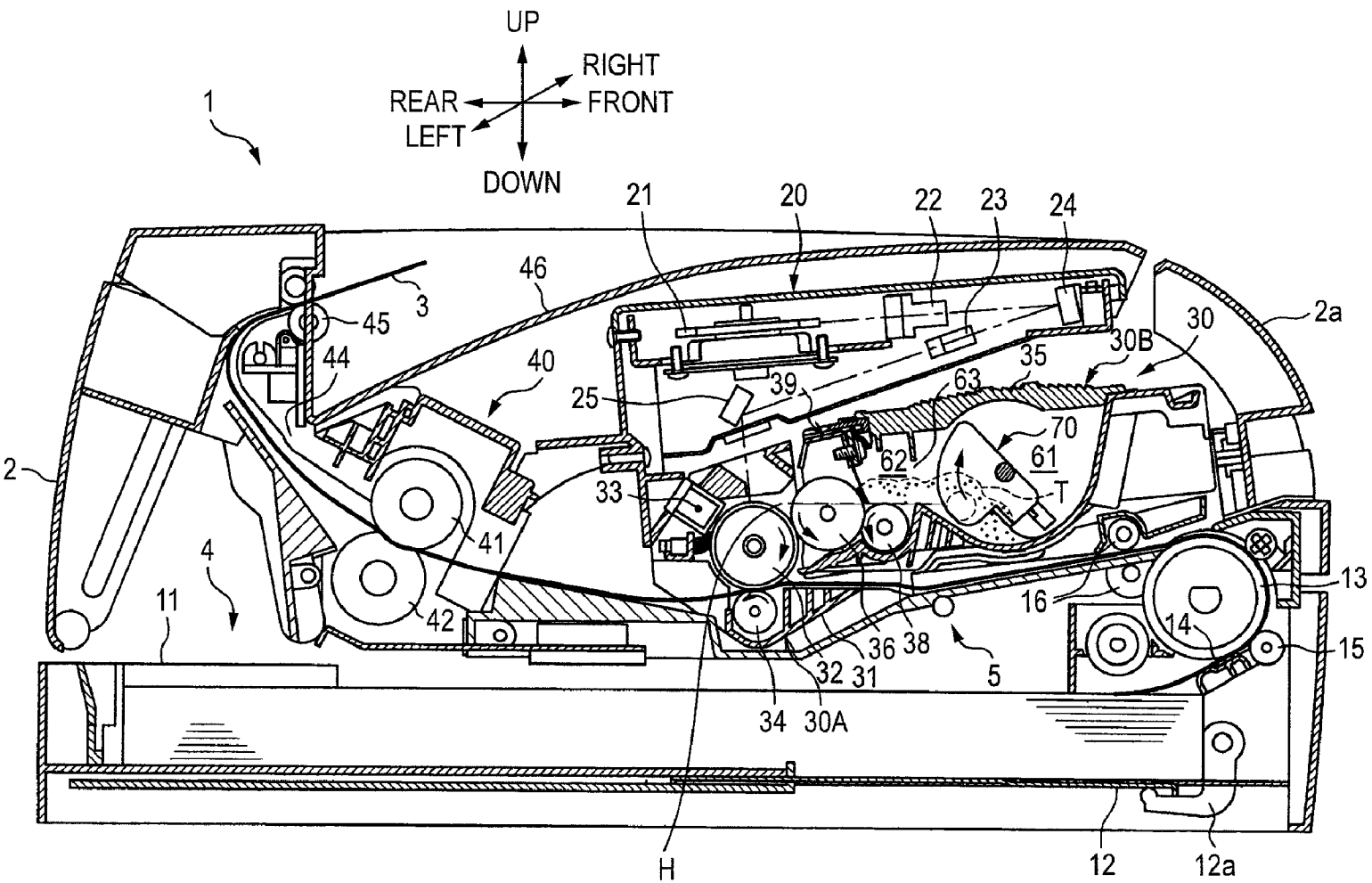
FIG. 1 is a side sectional view illustrating a laser printer.

As shown in FIG. 1, a laser printer 1 includes a feeder unit 4 that feeds a sheet 3 into a main casing 2 and an image forming unit 5 that forms an image onto the fed sheet 3.

An openable front cover 2*a* is disposed on the front side (the right in FIG. 1 is referred to as "front side" and the left is referred to as "rear side" in the following description) of the main casing 2. A process cartridge 30 to be described later can be freely attached and detached through an opening when the front cover 2*a* is opened.

<Configuration of Feeder Unit>

The feeder unit 4 (an example of a conveying unit) includes: a sheet feeding tray 11 that is detachably attached to the bottom of the main casing 2; a sheet pressing plate 12 that is pivotally disposed on the lower portion of the sheet feeding tray 11, and a lift lever 12*a* that upwardly urges the sheet pressing plate 12 to lift the front end of the sheet pressing plate 12 from the lower portion of the sheet feeding tray 11. A feed roller 13 and a feed pad 14 are disposed at the front-upper side of the sheet feeding tray 11, and a pinch roller 15 is disposed to face the feed roller 13. Registration rollers 16 are disposed in the rear of the upper edge of the feed roller 13.

With the feeder unit 4 having the above-mentioned configuration, a sheet 3 in the sheet feeding tray 11 is lifted by the lift lever 12*a* and the sheet pressing plate 12 to be close to the feed roller 13, is sent from the feed roller 13 and the feed pad 14, passes through various rollers 13 to 16, and then is conveyed to the image forming unit 5 sheet by sheet.

<Configuration of Image Forming Unit>

The image forming unit 5 includes a scanner unit 20, a process cartridge 30, and a fixing unit 40.

<Configuration of Scanner Unit>

The scanner unit 20 is an example of an exposing unit and is disposed in an upper portion of the main casing 2. The scanner unit includes a laser emitting portion (not shown), a polygon mirror 21 that is driven rotationally, lenses 22 and 23, and reflecting mirrors 24 and 25. A laser beam based on image data and emitted from the laser emitting portion passes through or is reflected by the polygon mirror 21, the lens 22, the reflecting mirror 24, the lens 23, and the reflecting mirror 25 in this order to be applied onto the surface of a photoconductive drum 32 of the process cartridge 30, as indicated by a chained line.

<Configuration of Process Cartridge>

The process cartridge 30 is disposed below the scanner unit 20 and is detachably attached to the main casing 2. The process cartridge 30 includes a photoconductor cartridge 30A that supports the photoconductive drum 32, and a developer cartridge 30B that is detachably attached to the photoconductor cartridge 30A and that contains a toner as a developer therein.

The photoconductor cartridge 30A includes a photoconductor case 31 forming an outer frame, and the photoconductive drum 32, a scorotron charging unit 33, and a transfer roller 34 that are disposed in the photoconductor case 31.

The developer cartridge 30B is an example of a developing unit, is detachably attached to the photoconductor cartridge 30A, and includes a developer case 35, and a developing roller 36, a supply roller 38, a blade assembly 39, and an agitator 70 that are disposed in the developing case 35. The developing roller 36, the supply roller 38, and the agitator 70 are rotatably supported by the developer case 35. The toner T in the developer case 35 is supplied to the developing roller 36 when the supply roller 38 is rotated in the arrow direction (counterclockwise), and concurrently is charged positively between the supply roller 38 and the developing roller 36 by friction. As the developing roller 36 is rotated in the arrow direction (counterclockwise), the toner T supplied onto the developing roller 36 enters between the thickness-regulating blade assembly 39 and the developing roller 36, and is held as a thin layer having a constant thickness on the developing roller 36.

The photoconductive drum 32 is supported by the photoconductor case 31 coupled to the developer cartridge 30B so as to be rotatable in the arrow direction (clockwise). The photoconductive drum 32 includes a grounded drum member and a positively-chargeable photoconductive layer as the surface of the member 32.

The scorotron charging unit 33 is disposed above the photoconductive drum 32 to be opposed to the photoconductive drum 32 with a predetermined gap therebetween not to come in contact with the photoconductive drum. The scorotron charging unit 33 is a positive-charging scorotron type charging device that generates a corona discharge from a charging wire of tungsten and is configured to uniformly charge the surface of the photoconductive drum 32 positively.

The transfer roller 34 is an example of a transfer unit, is disposed below the photoconductive drum 32 so as to come in contact with the photoconductive drum 32, and is supported by the photoconductor case 31 so as to be rotatably in the arrow direction (counterclockwise). The transfer roller 34 is constructed such that a metal roller shaft is coated with a conductive rubber material. A transfer bias is applied to the transfer roller 34 by the static current control during transfer operation.

The surface of the photoconductive drum 32 is uniformly charged positive by the scorotron charging unit 33 and then is exposed by the high-speed scanning of a laser beam from the scanner unit 20. Accordingly, the potential of the exposed portion is lowered to form an electrostatic latent image based on the image data. Here, the "electrostatic latent image" means an exposed portion of which the potential is lowered due to the exposure to the laser beam in the surface of the photoconductive drum 32 uniformly charged positively. As the developing roller 36 is rotated, the toner carried on the developing roller 36 is brought into contact with the photoconductive drum 32 and thus supplied to the electrostatic latent image formed on the surface of the photoconductive drum 32. The toner T is selectively carried on the surface of the photoconductive drum 32 to form a visible toner image by reversal development (discharged area development).

Thereafter, the photoconductive drum 32 and the transfer roller 34 are rotationally driven to nip and convey the sheet 3 therebetween. The toner image carried on the surface of the photoconductive drum 32 is transferred to the sheet 3 when the sheet 3 passes between the photoconductive drum 32 and the transfer roller 34.

<Configuration of Fixing Unit>

The fixing unit 40 is an example of the fixing unit, is disposed downstream relative to the process cartridge 30, and includes a heating roller 41 and a pressing roller 42 that is opposed to the heating roller 41 so as to nip the sheet 3 between the heating roller 41 and the pressing roller. With the fixing unit 40 having the above-mentioned configuration, the toner transferred to the sheet 3 is thermally fixed while the sheet 3 passes between the heating roller 41 and the pressing roller 42 and then the sheet 3 is conveyed to a sheet discharging path 44. The sheet 3 sent to the sheet discharging path 44 is discharged onto a sheet discharging tray 46 by a discharge roller 45.

Figure 2:
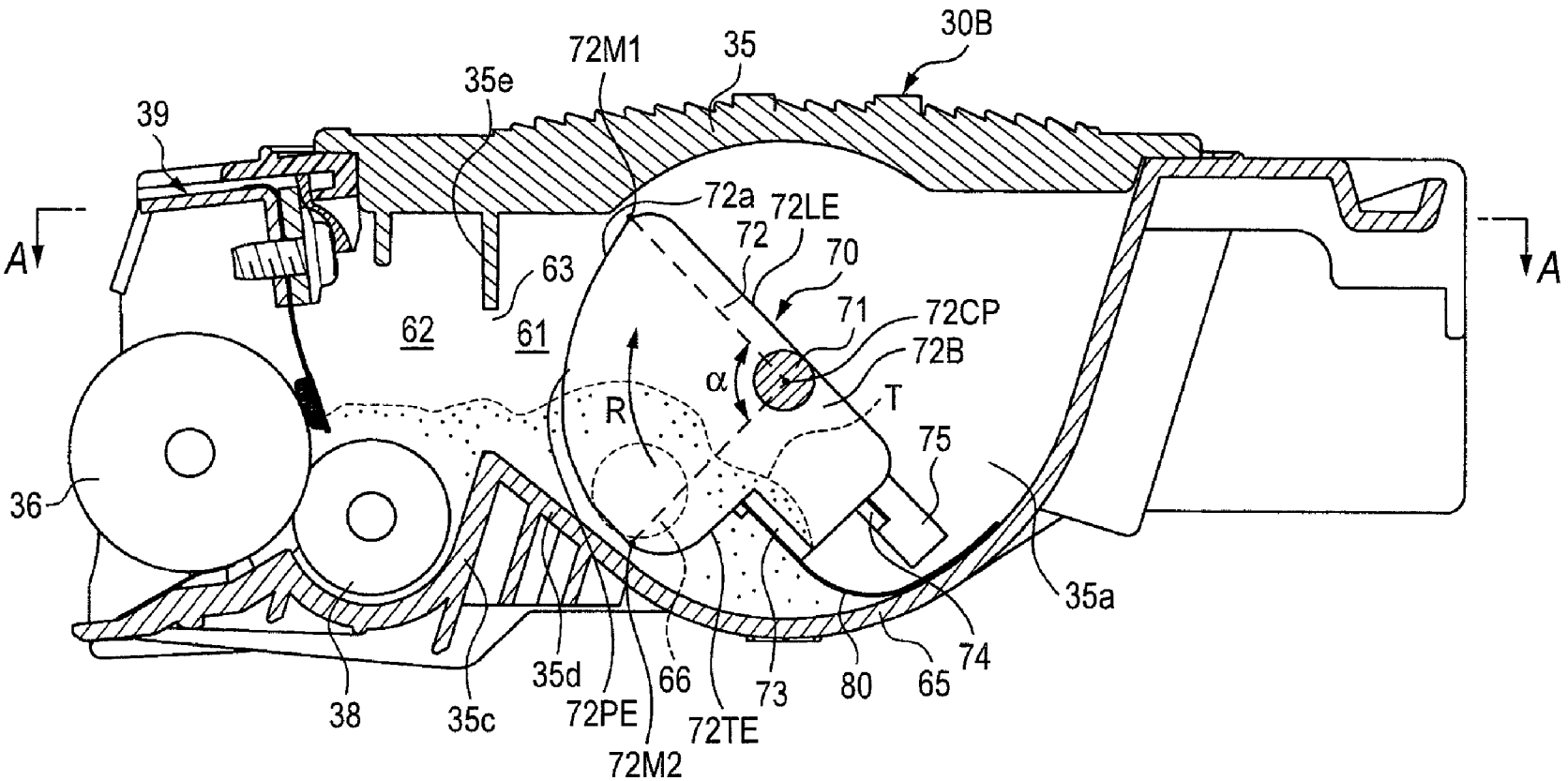
FIG. 2 is an enlarged sectional view illustrating a developing cartridge mountable to the laser printer.
Figure 3:
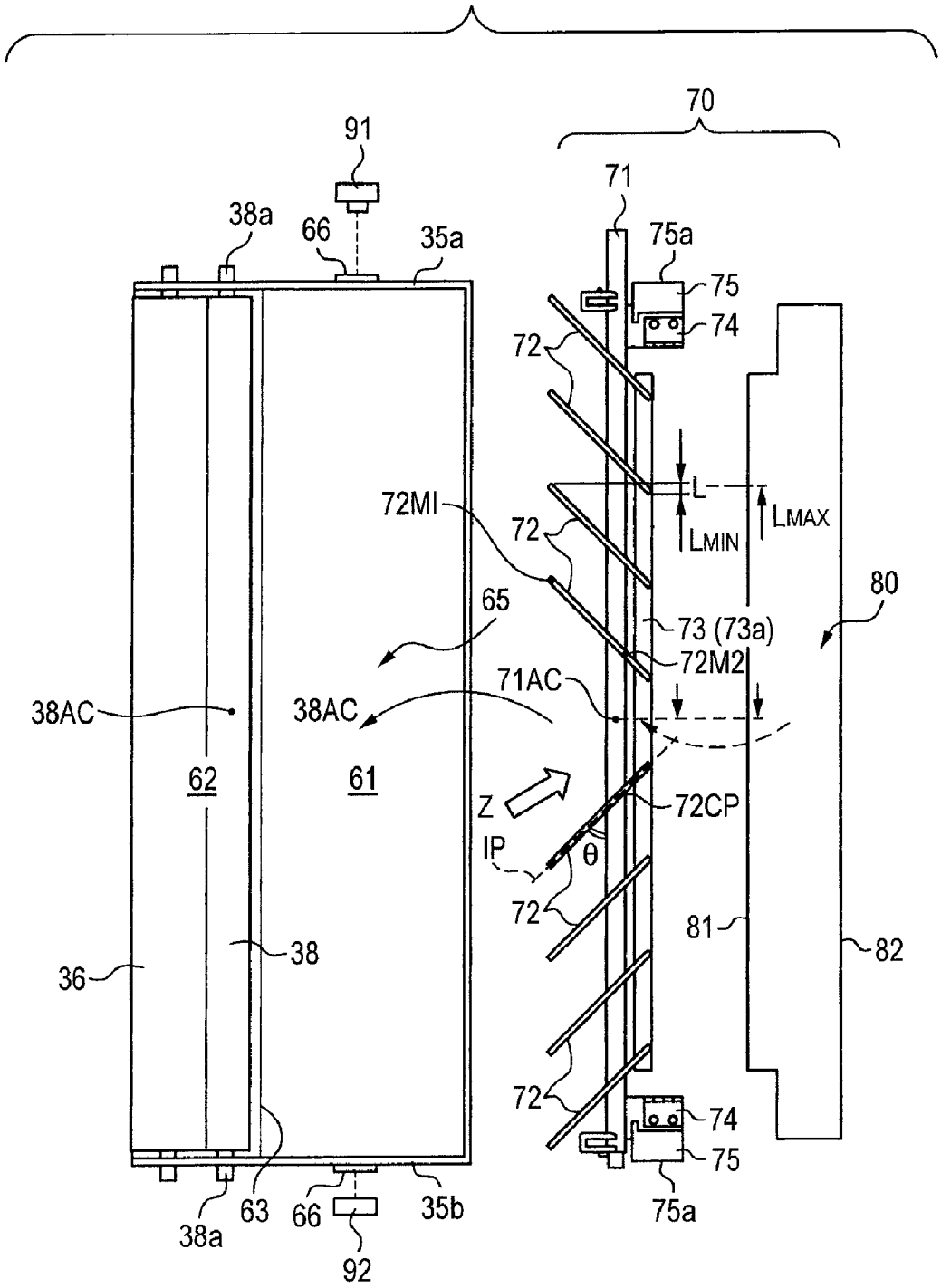
FIG. 3 illustrates an exploded state of the developing cartridge as viewed from the upside.
Figure 4:
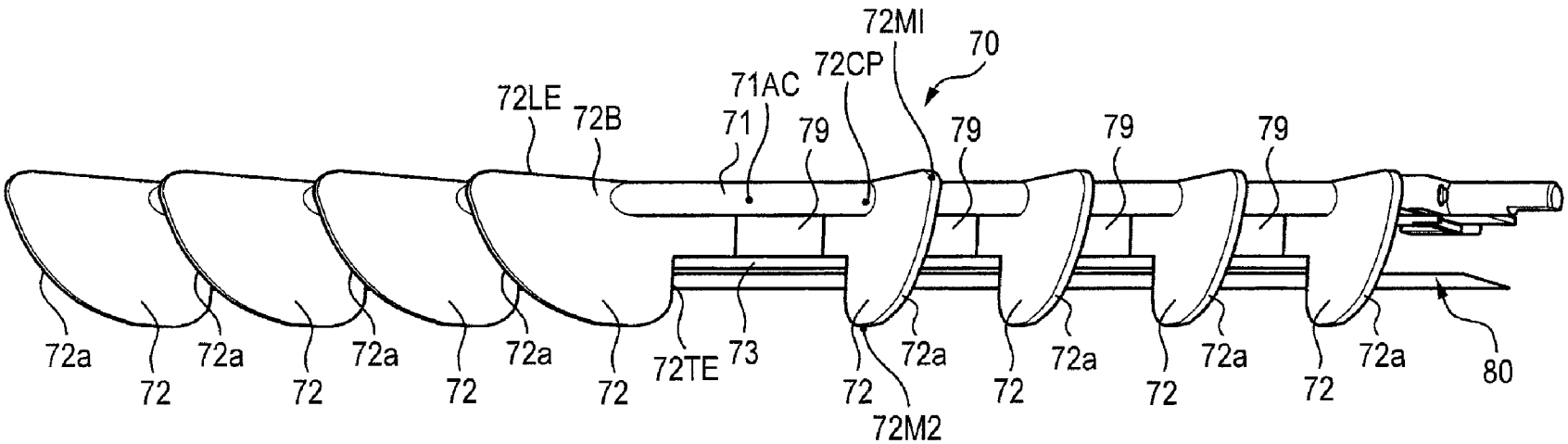
FIG. 4 illustrates an agitator of the developing cartridge as viewed in the direction of arrow Z in FIG. 3.

Details of the developing cartridge 30B will be described. FIG. 2 is an enlarged sectional view of the developing cartridge 30B. FIG. 3 shows an exploded state of the developing cartridge 30B as viewed from the upside. FIG. 4 shows the agitator 70 as viewed in the direction of arrow Z in FIG. 3.

As shown in FIG. 2, the inside of the developer case 35 is partitioned into a developer containing chamber 61 and a developing chamber 62. The developer containing chamber 61 and the developing chamber 62 communicate with each other through a communicating section 63.

As shown in FIG. 3, the communicating section 63 extends all over the entire width of the supply roller 38 (accurately, the entire axial length of a roller portion not including shaft portions 38*a*). The communicating section 63 permits the toner T to move between the developer containing chamber 61 and the developing chamber 62 all over the width within the developer case 35. Since the width of the communicating section 63 is equal to or greater than the maximum printing width, the toner T can flow without staying at least in any printing width (to be described later). Accordingly, an excellent supply of the toner T to a printing region can be realized The toner T is contained in the developer containing chamber 61. In order to agitate the toner T, the agitator 70 (an example of a developer agitating member) is disposed in the developer containing chamber 61.

The agitator 70 is rotatably supported by side walls 35*a* and 35*b* of the developer case 35. With an application of a rotational force from a motor not shown, the agitator 70 is rotated in the developer containing chamber 61 to agitate the toner T.

The bottom wall of the developing case 35 rises up in front of the supply roller 38 to form an upright wall 35*c*. The upright wall 35*c* has a height substantially corresponding to ⅓ of a height of the developer case 35 so that the upright wall 35*c* is substantially as high as the uppermost portion of the roller surface of the supply roller 38 when the developing cartridge 30B is mounted to the laser printer 1 (see a line H in FIG. 1). Since the upright wall 35*c* is as high as the uppermost portion of the roller surface of the supply roller 38, the toner T in the developing chamber 62 is accumulated on the supply roller 38, and thus the toner can be smoothly and uniformly supplied to the supply roller 38 over the entire axial length thereof. It is preferable from this point of view that the upright wall 35*c* is not lower than the uppermost portion of the roller surface of the supply roller 38 when the developing cartridge 30B is used.

The bottom wall 65 of the developer containing chamber 61 has a cylindrical surface extending substantially along the rotational locus of the agitator 70. An inclined wall 35*d* extends from the cylindrical bottom wall 65 in a tangential direction, and is connected to the uppermost portion of the upright wall 35*c*.

The upright wall 35*c* and the inclined wall 35*d* serve as a part of a partition that partitions the developing chamber 62 and the developer containing chamber 61 one from the other.

A partition wall 35*e* extends downward form the top wall of the developer case 35 toward the uppermost portion of the upright wall 35*c*, and a space defined between the upright wall 35*c* and the partition wall 35*e* serves as the communicating section 63.

Transparent detection windows 66 for optically detecting an amount of remaining toner T are respectively disposed in the side walls 35*a* and 35*b* of the developer case 35 (only the side wall 35*a* is shown in FIG. 2).

As shown in FIG. 3, the laser printer 1 has a light-emitting portion 91 that is disposed in the vicinity of one detection window 66 and a light-receiving portion 92 that is disposed in the vicinity of the other detection window 66. The amount of remaining toner T is detected by the use of an optical sensor including the light-emitting portion 91 and the light-receiving portion 92.

The agitator 70 includes a rotation shaft 71, vanes 72, a connecting portion 73, wiper attaching portions 74, wipers 75, and a flexible sheet member 80.

The rotation shaft 71 extends in a direction parallel to the axis of the supply roller 38, that is, in the right-and-left direction of the developer case 35. The rotation shaft 71 is rotatably supported at its axial ends to the side walls 35*a* and 35*b* of the developer case 35. The rotation shaft 71 has an axial center 71AC that corresponds in location to an axial center 38AC of the supply roller 38 (i.e. a center of the entire axial length of a roller portion of the supply roller 38 not including the shaft portions 38*a*).

Each of the vanes 72 is in the form of a plate-shaped member fixed to the rotation shaft 71. The vanes 72 are configured to agitate and convey the toner T when the rotation shaft 71 is rotated. In this example, each of the vane 72 includes: a base 72B connected to the support shaft 71; a leading edge 72LE extending from the base 72B; a trailing edge 72TE extending from the base 72B; and an arcuate peripheral edge 72PE. The arcuate peripheral edge 72PE meets the leading edge 72LE at a first point 72M1 and the trailing edge 72TE at a second point 72M2. Further, the base 72B of the vane 72 defines a geometrical connection point 72CP on the axis of the rotation shaft 71 (i.e. a geometrical connection point between the vane 72 and the rotation shaft 71). The vanes 72 are oblique (i.e. non-perpendicular) with respect to the axis of the rotation shaft 71. Specifically, an imaginary plane IP defined by and containing therein the connection point 72CP, the first point 72M1 and the second point 72M2 is inclined (non-perpendicular) with respect to the axis of the rotation shaft 71 such that the second point 72M2 is located between the axial center 71AC and the first point 72M1 as viewed in a direction perpendicular to the axis of the rotation shaft 71 (see, for example, FIG. 3). In this example, because the vane 72 is in the form of a thin plate having a planer plate surface, the imaginary plane IP can be regarded as the plate surface of the vane 72. Because a distance between the first point 72M1 and the connection point 72CP as measured along the imaginary plane IP is longer than a distance between the second point 72M2 and the connection point 72CP as measured along the imaginary plane IP in this example, the inclined or oblique direction of the plate surface of the vane 72 in this example may be expressed such that the second point 72M2 close to the rotation shaft 71 is closer to the axial center 71AC of the rotation shaft 71 (simply referred to as an inside) and the first point 72M1 distant from the rotation shaft 71 is farther from the axial center 71AC of the rotation shaft 71 (simply referred to as an outside). The angle θ of the vanes 72 with respect to the axis of the rotation shaft 71 is preferably in the range of 40° to 60° and more preferably 45° in order to efficiently move the toner T toward the inside. That is, when the angle θ is too small, the toner T cannot be moved toward the inside. When the angle is too great, the toner T cannot be efficiently moved toward the inside because the distance by which the toner can be moved by one rotation is very small. In addition, the first point 72M1 is located away from the second point 72M2 at an angular interval a of about 90° with respect to the axis of the rotation shaft 71 in this example, as shown in FIG. 2.

Each of the vanes 72 has sufficient rigidity to move the toner T toward the inside.

As indicated by the arrow R in FIG. 2, the agitator 70 rotates clockwise in FIG. 2 so as to send the toner T collected on the bottom wall 65 to the developing chamber 62. Using the rotation direction of the agitator 70, the oblique direction of the vane 72 may be expressed such that the downstream end of the peripheral edge 72PE in the rotation direction (i.e. the second point 72M2 on the trailing edge 72TE) is more inside than the upstream end of the peripheral edge 72PE (i.e. the first point 72M1 on the leading edge 72LE).

The vanes 72 are preferably arranged at a constant interval over a width corresponding to the width of the communicating section 63. In this example, as best shown in FIG. 3, the eight vanes 72 are grouped into a first group located between the axial center 71AC and one axial end of the rotation shaft 71 and a second group located between the axial center 71AC and the other axial end of the rotation shaft 71, and the four vanes 72 (i.e. the connection points 72CP of the vanes 72) of the first group are arranged at a constant interval and the four vanes 72 (i.e. the connection points 72CP of the vanes 72) of the second group are arranged at the constant interval. Further, the eight vanes in total are disposed symmetric with respect to the axial center 71AC of the rotation shaft 71 in this example. Not that, the vanes 72 may be arranged asymmetric and/or may be arranged at varying intervals. The vanes 72 can be configured and arranged in various ways so long as the vanes 72 can convey the toner T in the developer containing chamber 61 from the outside to the inside.

As shown in FIG. 2, the end 72*a* of the vane 72 (i.e. the peripheral edges 72PE) distant from the rotation shaft 71 has a profile corresponding to the bottom wall 65 of the developer containing chamber 61 in order to agitate and scoop the toner T, collected and accumulated in the bottom wall 65 of the developer containing chamber 61, as many as possible. As shown in FIG. 3, the vanes 72 are arranged such that a leading end side of one of the vanes 72 partially overlaps, by a length L in the axis direction of the rotation shaft 71, with a trailing end side of another one of the vanes 72, which is adjacent to the one of the vanes 72 and is located outside of the one of the vanes 72. That is, the vanes 72 are so designed and arranged that a minimal distance L-MIN between the vane 72 and the axial center 71AC is smaller than a maximum distance L-MAX between the inwardly located, adjacent vane 72 and the axial center 71AC as shown in FIG. 3. Accordingly, the toner T collected in the bottom wall 65 can be wiped out without leaving any toner by the vanes 72 and can be efficiently conveyed toward the inside.

The connecting portion 73 extends in the axis direction of the rotation shaft 71 so as to connect the downstream portions, in the rotation direction, of the vanes 72. The connecting portion 73 is a rectangular strip member having a planar portion on the lower surface in FIG. 2. The lower planar portion serves as an attachment portion 73*a* to which the flexible sheet member 80 is attached.

The connecting portion 73 connects the vanes 72 at positions apart from the rotation shaft 71. Accordingly, as shown in FIG. 4, toner flowing holes (passages) 79 are formed between the rotation shaft 71 and the connecting portion 73.

Two wiper attaching portions 74 are respectively disposed on the rotation shaft 71 in the vicinity of the axial ends thereof. The wiper attaching portions 74 are disposed downstream in the rotation direction relative to the vanes 72, as shown in FIG. 2.

The wiper 75 serves to wipe out the toner T attached to the detection window 66, and is formed of a flexible member such as a vinyl chloride sheet or a rubber sheet with a thickness of about 2 mm. The outer edge 75*a* of the wiper 75 opposed to the detection window 66 is formed in a linear shape. The wiper 75 presents a substantially rectangular shape. The wiper 75 is attached to the wiper attaching portion 74.

The flexible sheet member 80 (an example of an elastically deformable member) serves to scrape and convey the toner T collected in the bottom wall 65 of the developer containing chamber 61 toward the developing chamber 62. The flexible sheet member 80 is preferably a resin sheet having great flexibility, such as a PET (polyethylene terephthalate) sheet.

The length (length from the base end 81 attached to the attachment portion 73*a* to the free end 82) of the flexible sheet member 80 is set such that the free end 82 can come in sliding contact with the bottom wall 65 and that the free end 82 can extend linearly into the developing chamber 62 when the flexible sheet member 80 is directed to the developing chamber 62. Accordingly, the free end 82 of the flexible sheet member 80 comes in sliding contact with the bottom wall 65 and the inclined wall 35*d* while keeping a bent state, and thereafter the free end 82 extends linearly into the developing chamber 62 by restoration from the bent state to convey the toner T into the developing chamber 62.

The width of the free end 82 corresponds to the entire width of the developer containing chamber 61, and the width of the base end 81 corresponds to the width of the attachment portion 73*a*. Since the attachment portion 73*a* is slightly smaller than the width of the developer containing chamber 61, the width of the base end 81 of the flexible sheet member 80 is also slightly smaller than the width of the developer containing chamber 61. In this way, the width of the base end 81 is smaller than the width of the free end 82, and the base end 81 inwardly apart from the ends of the free ends 82 is fixed to the agitator 70. Accordingly, since the flexible sheet member 80 flexures more in the vicinity of the ends thereof, the force of the flexible sheet member for conveying the toner T is slightly weakened at the ends of the flexible sheet member 80 in comparison with the center portion thereof.

Operation of the laser printer 1 having the above-mentioned configuration will be described.

In accordance with a print command requested from a terminal device, the laser printer 1 feeds a sheet 3, and transfers and fixes a toner image onto the sheet 3. In this print operation, the toner T in the developer containing chamber 61 is agitated and supplied by the agitator 70 to the supply roller 38.

Figure 5:
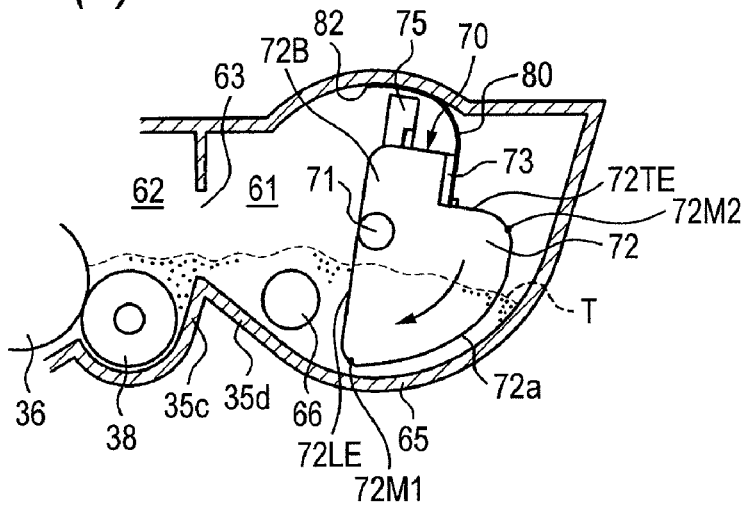
FIGS. 5(*a*), 5(*b*) and 5(*c*) are cross-sectional views illustrating an operation of the developing cartridge when an amount of toner is large.
Figure 5:
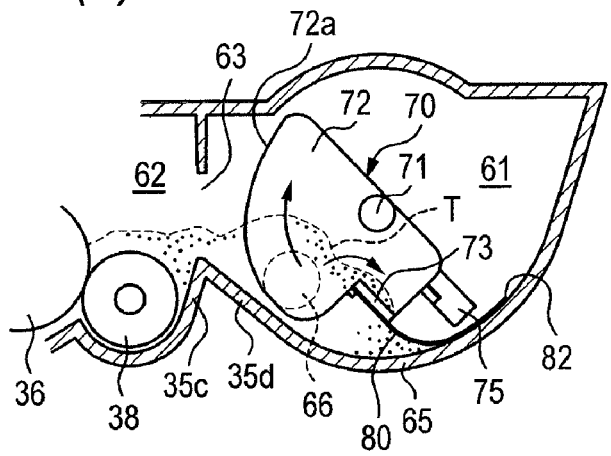
Figure 5:
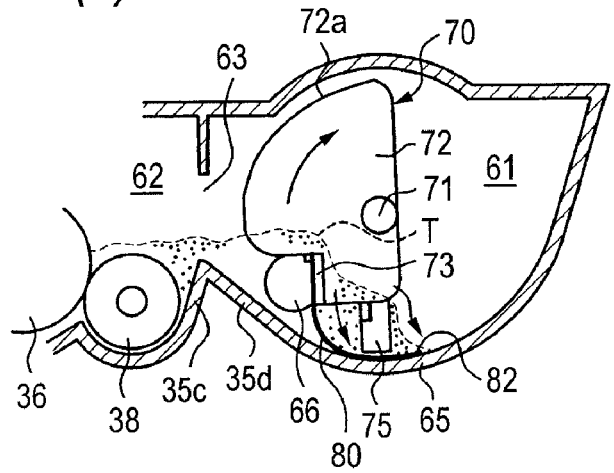
Figure 6:
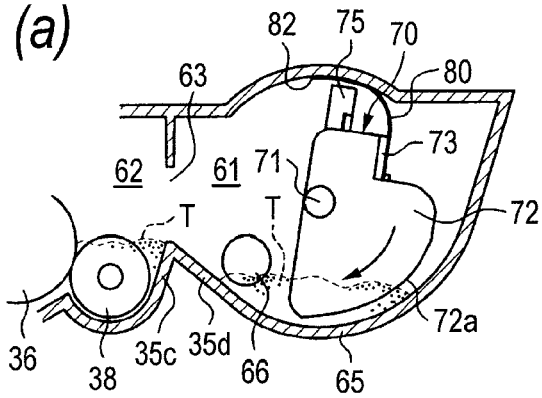
FIGS. 6(*a*), 6(*b*), 6(*c*) and 6(*d*) are cross-sectional views illustrating an operation of the developing cartridge when the amount of toner is small.
Figure 6:
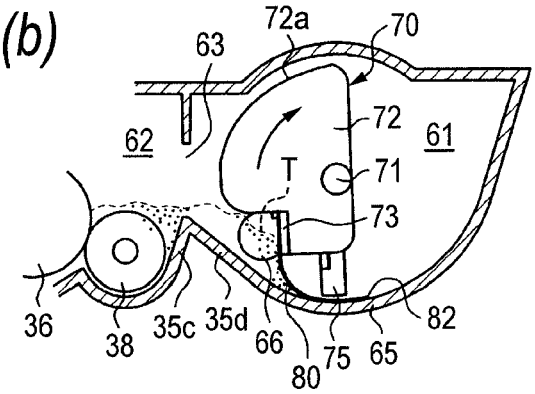
Figure 6:
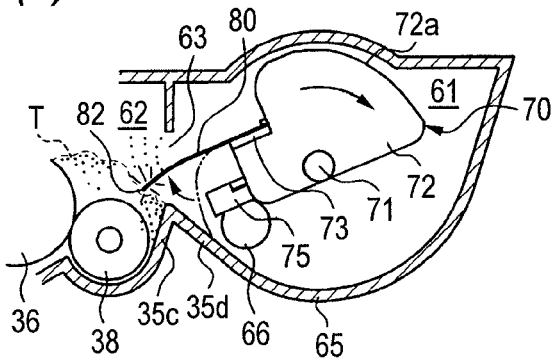
Figure 6:
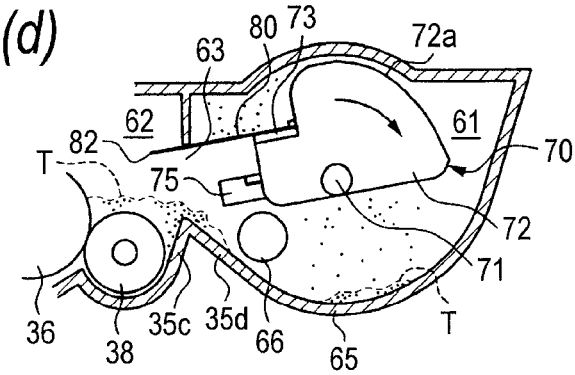
Figure 8:
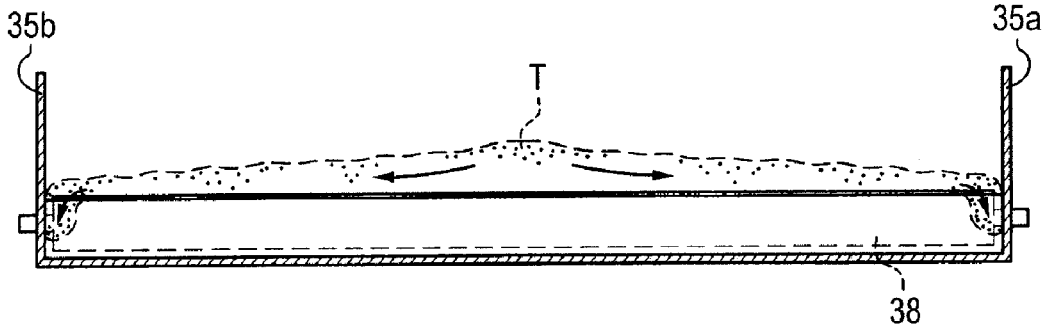
FIG. 8(*a*) is a cross-sectional view taken along Line VIII-VIII of FIG. 7(*a*) and FIG. 8(*b*) is a cross-sectional view taken along Line A-A of FIG. 2, which conceptually shows a flow of the toner in a supply chamber.
Figure 8:
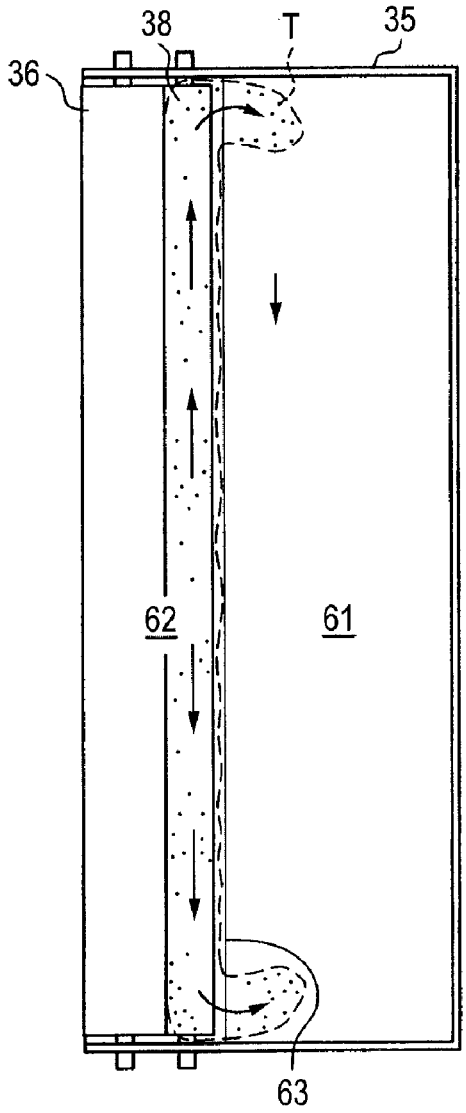
Figure 9:
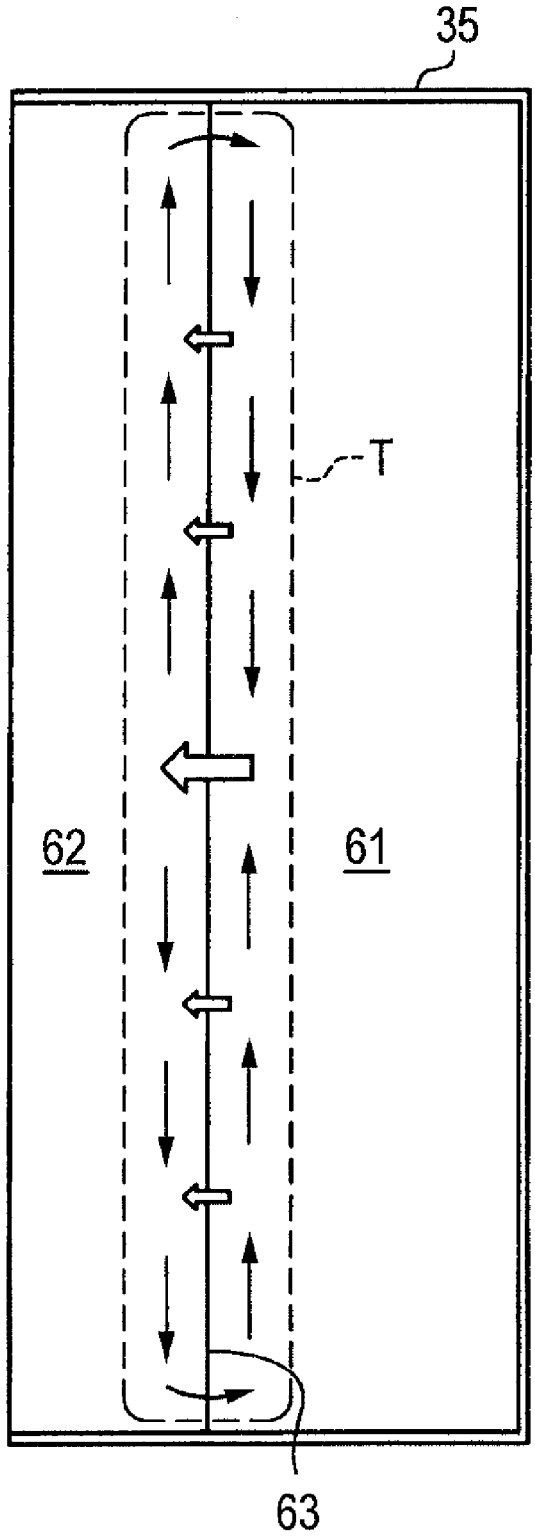
FIG. 9 is a cross-sectional view taken along Line A-A of FIG. 2, which conceptually shows a flow of the toner.

FIGS. 5(*a*) to 5(*c*) are cross-sectional views illustrating an operation of the developing cartridge when an amount of toner is large. FIGS. 6(*a*) to 6(*d*) are cross-sectional views illustrating an operation of the developing cartridge when the amount of toner is small. FIG. 7(*a*) is a diagram corresponding to a cross-sectional view taken along Line A-A of FIG. 2, which shows a flow of the toner in the state shown in FIG. 6(*b*). FIG. 7(*b*) is an enlarged diagram of the wiper 75. FIG. 7(*c*) is a cross-sectional view taken along Line VII-VII of FIG. 7(*a*). FIG. 8(*a*) is a cross-sectional view taken along Line VIII-VIII of FIG. 7. FIG. 8(*b*) is a diagram corresponding to the cross-sectional view taken along Line A-A of FIG. 2, which conceptually shows a flow of the toner in a supply chamber. FIG. 9 is a diagram corresponding to the cross-sectional view taken along Line A-A of FIG. 2, which conceptually shows a flow of the toner.

As shown in FIG. 5(*a*), in a case in which the amount of toner T is large, when the agitator 70 is rotated, the ends 72*a* of the vanes 72 enter the toner T collected in the bottom (bottom wall 65) of the developer containing chamber 61.

As shown in FIG. 5(*b*), when the vanes 72 are further rotated to direct the ends 72*a* toward the developing chamber 62, the flexible sheet member 80 is rotated while the free end 82 comes in sliding contact with the bottom wall 65, thereby sufficiently conveying the toner T toward the developing chamber 62. In this state, the surplus toner T starts dropping toward the bottom wall 65 through the toner flowing holes 79 between the rotation shaft 71 and the connecting portion 73.

As shown in FIG. 5(*c*), when the agitator 70 is further rotated to direct the ends 72*a* toward the upside, the flexible sheet member 80 further pushes the toner T toward the developing chamber 62. However, since the toner T cannot enter the developing chamber 62 more than necessary, the toner T flows and drops from the toner flowing holes 79 onto the bottom wall 65. Since the toner T flows and drops like an avalanche, the toner T is maintained in a dispersed state of fine particles, unlike a case where the toner T is simply pushed and moved.

As shown in FIG. 6(*a*), in a case in which the amount of toner T is small, the ends 72*a* of the vanes 72 of the agitator 70 enter the toner T and push the toner toward the developing chamber 62. As shown in FIG. 6(*b*), when the ends 72*a* of the vanes 72 are directed upward, the toner T on the vanes 72 flows and drops toward the inside along the surfaces of the vanes 72. This state is shown in FIGS. 7(*a*) and 7(*b*). As shown in FIGS. 7(*a*) and 7(*b*), as the ends 72*a* of the vanes 72 is directed more upward from the rear side (from developing chamber 62), the vanes 72 faces the upside so that the toner T is scooped and placed onto the vanes 72. Because the vanes 72 are tilted with respect to the rotation shaft 71 so that the downstream portion in the rotation direction is more inside than the upstream portion, the toner T drops along the surfaces of the vanes 72 to move toward the inside when the vanes 72 are directed upward.

When the agitator 70 is further rotated, the flexible sheet member 80 collects the small amount of toner T while the free end 82 comes in sliding contact with the bottom wall 65, and fully conveys the toner T toward the developing chamber 62. When the free end 82 exceeds a position of the rear end of the inclined wall 35*d*, the free end 82 is elastically restored to splash the toner T into the developing chamber 62 as shown in FIG. 6(*c*). Since the toner T is moved toward the inside in the developer containing chamber 61, the toner is conveyed to the developing chamber 62 just after getting close to the inside.

Accordingly, as shown in FIG. 8(*a*), a lot of toner T is conveyed to the center of the supply roller 38 so that the toner T swells around the center of the supply roller 38. Since the conveying force of the flexible sheet member 80 is also smaller in the vicinity of both ends than at the center, a lot of toner T is conveyed to the center of the supply roller 38.

When the agitator 70 is further rotated, the free end 82 of the flexible sheet member 80 linearly extends fully into the developing chamber 62, as shown in FIG. 6(*d*).

Of the toner T supplied to and disposed on the supply roller 38, the toner around the surface of the supply roller 38 is conveyed by the surface of the supply roller 38 to the developing roller 36. The surplus toner rolls on and thus is agitated by the surface of the supply roller 38 as the supply roller 38 is rotated. Since the agitated toner T tends to flow from a high place to a low place, the toner flows from the center of the supply roller 38 toward the ends thereof (toward the outside), as shown in FIGS. 8(*a*) and 8(*b*). The toner T reaching to the ends of the supply roller 38 overflows into the developer containing chamber 61.

Of course, although all the toner T does not comply with such a flow and some toner drops back to the developer containing chamber 61 from the upper portion of the center of the supply roller 38, the above-mentioned flow of the toner T in the axis direction is facilitated as a consequence of the conveyance of more toner T to the center of the supply roller 38.

The toner T returned to the developer containing chamber 61 is agitated again by the vanes 72 in the vicinity of the bottom wall 65 and is moved toward the inside. This way, the movement of the toner T to the developing chamber 62 and the return flow of the toner T to the developer containing chamber 61 are repeated As shown in FIG. 9, the toner T in the developer containing chamber 61 is moved toward the inside, and the toner T in the developing chamber 62 is moved away from the inside. Accordingly, the toner T circulates in the developing cartridge 30B without staying, thereby keeping the toner T in a good state.

Further, the laser printer 1 can accurately detect the amount of remaining toner T in the following manner.

First, a method of determining the amount of remaining toner T will be described. The amount of remaining toner T is not determined only on the basis whether an optical sensor senses the transmission of light, but also on the basis of a duration lasting from a time point at which light passes to a time point at which the light is subsequently blocked. If this duration is short, it means that the toner T drops again onto the bottom wall 65. Accordingly, it can be determined that the amount of remaining toner is large. If this duration is long, it means that the toner T does not drop well, or that the light is first blocked by the vanes 72 passing therethrough. Accordingly, it can be determined that the amount of remaining toner is small.

The developing cartridge 30B has the wiper 75 attached to the downstream side, in the rotation direction, of the vanes 72. Further, the flexible sheet member 80 is also attached to the downstream side, in the rotation direction, of the vanes 72. Accordingly, as shown in FIGS. 6(*b*) and 6(*c*), the wiper 75 wipes out the detection window 66 immediately after the vanes 72 completes the agitation of the toner T and the flexible sheet member 80 completes the scrape of the toner T. Accordingly, since the time for effectively using the detection window 66 is as long as possible, the laser printer 1 can accurately detect the amount of remaining toner T.

The developing cartridge 30B as described above can be modified in various ways.

Although the flexible sheet member 80 is fixed to the connecting portion 73 apart from the rotation shaft 71, the flexible sheet member 80 may be directly fixed to the vanes 72. Alternatively, the flexible sheet member 80 may be fixed to the rotation shaft 71.

The communicating portion 63 may not be formed necessarily all over the width of the developer containing chamber 61, but by forming the communicating portion all over the width of the developer containing chamber 61, it is possible to prevent the toner T from staying in the developing cartridge 30B as sufficiently as possible.

As discussed above, the present invention can provide at least the following illustrative, non-limiting embodiments:

(1) A developing unit including: a developer case that defines a developer containing chamber containing a developer and a developing chamber communicating with the developer containing chamber through a communicating section; a supply roller disposed in the developing chamber; and a developer agitating member having a plurality of vanes that are disposed in the developer containing chamber and that are rotatable about an axis parallel to an axis of the supply roller, wherein each of the vanes has a peripheral edge, and a trailing end of the peripheral edge in a vane rotation direction is located more inside than a leading end of the peripheral edge. The developing unit of (1) preferably includes a flexible sheet member having a base end supported by the developer agitating member and a free end that can come in sliding contact with a bottom wall of the developer containing chamber.

With the developing unit of (1), the developer in the developer containing chamber is conveyed from the outside in the axis direction of the developer agitating member to the inside by the vanes of the developer agitating member. The developer conveyed to the inside is conveyed to the supply roller in the developing chamber. This convey of the supply roller can be further facilitated by the flexible sheet member sliding on the bottom wall of the developer containing chamber.

Consequently, more developer is conveyed to the inside in the axis direction, i.e. the central portion of the supply roller, that is, the vicinity of the center. In other words, an amount of the developer conveyed from the developing chamber to the axial end portions of the supply roller is small. Accordingly, the developer in the developing chamber flows from the inside in the axis direction of the supply roller to the outside and the surplus of the flowing developer flows over from the axial ends of the supply roller toward the developer containing chamber.

This way, a flow of the developer from the outside in the axis direction to the inside occurs in the developer containing chamber and a flow of the developer from the inside in the axis direction to the outside occurs in the developing chamber. Accordingly, the toner flows all over the interior of the developer case, thereby preventing the toner from staying at axial ends. Therefore, the developer in the developer case is agitated well without staying.

(2) A process cartridge including: the developing unit of (1); and a photoconductor cartridge having a photoconductor case coupled to the developing unit and a photoconductive drum that is disposed in the photoconductor case and that presses against a developing roller.

(3) An image forming device including: the process cartridge of (2); an exposing unit that exposes the photoconductive drum; a conveying unit that conveys a printing sheet to the process cartridge; and a fixing unit that fixes a developer image formed on the printing sheet by the process cartridge.

According to the developing unit of (1), the process cartridge of (2), and the image forming device of (3), since a flow of toner toward the inside or outside in the axis direction of the supply roller and a flow of toner between the developer containing chamber and the developing chamber can be both realized in the developer case by the vanes of the developer agitating member. The flexible sheet member can further facilitate these flows of the toner.

What is claimed is:

1. A developing unit comprising: a developer case that defines a developer containing chamber containing a developer and a developing chamber communicating with the developer containing chamber through a communicating section; a supply roller disposed in the developing chamber and rotatable about a first axis; and a developer agitating member having a plurality of vanes that are disposed in the developer containing chamber and that are rotatable about a second axis parallel to the axis of the supply roller, wherein each of the vanes has a peripheral edge, and a trailing end of the peripheral edge in a vane rotation direction is located more inside than a leading end of the peripheral edge.

2. The developing unit according to claim 1 further comprising: a flexible sheet member having a base end supported by the developer agitating member and a free end that is configured to come in sliding contact with a bottom wall of the developer containing chamber.

3. The developing unit according to claim 2, wherein the flexible sheet member has such a width and a length that the flexible sheet member is configured to linearly extend into the developing chamber when the free end is directed to the communicating section.

4. The developing unit according to claim 2, wherein the flexible sheet member has end portions and a central portion located between the end portions in a direction parallel to the second axis, and the end portions of the flexible sheet member are more flexible than the central portion of the flexible sheet member.

5. The developing unit according to claim 1, wherein the vanes are disposed over a width corresponding to a width of the communicating section, and arranged at a constant interval.

6. The developing unit according to claim 1, wherein each of the vanes forms an angle in the range of 40° to 60° with respect to the second axis.

7. The developing unit according to claim 1, wherein the developer agitating member has a rotation shaft extending on and along the second axis, and the rotation shaft and the flexible sheet member define a passage therebetween so that the developer is configured to pass through the passage.

8. The developing unit according to claim 1, wherein a portion of the developer case partitioning the developing chamber and the developer containing chamber is at least as high as an uppermost portion of the supply roller when the developing unit is mounted to an image forming apparatus.

9. The developing unit according to claim 1, wherein one of the vanes partially overlaps, in a direction parallel to the second axis, with another one of the vanes which is adjacent to the one of the vanes and located outside the one of the vanes.

10. A process cartridge comprising: a developing unit comprising: a developer case that defines a developer containing chamber containing a developer and a developing chamber communicating with the developer containing chamber through a communicating section; a supply roller disposed in the developing chamber and rotatable about a first axis; a developer agitating member having a plurality of vanes that are disposed m the developer containing chamber and that are rotatable about a second axis parallel to the axis of the supply roller, wherein each of the vanes has a peripheral edge, and a trailing end of the peripheral edge in a vane rotation direction is located more inside than a leading end of the peripheral edge; and a developing roller rotatably supported by the developer case and contacted with the supply roller; and a photoconductor cartridge comprising: a photoconductor case coupled to the developing unit; and a photoconductive drum that is disposed in the photoconductor case and that is pressed against the developing roller.

11. An image forming device comprising:

a process cartridge comprising:

a developing unit comprising:

a developer case that defines a developer containing chamber containing a developer and a developing chamber communicating with the developer containing chamber through a communicating section;

a supply roller disposed in the developing chamber and rotatable about a first axis;

a developer agitating member having a plurality of vanes that are disposed in the developer containing chamber and that are rotatable about a second axis parallel to the axis of the supply roller, wherein each of the vanes has a peripheral edge, and a trailing end of the peripheral edge in a vane rotation direction is located more inside than a leading end of the peripheral edge; and a developing roller rotatably supported by the developer case and contacted with the supply roller; and a photoconductor cartridge comprising:

a photoconductor case coupled to the developing unit; and a photoconductive drum that is disposed in the photoconductor case and that is pressed against the developing roller;

an exposing unit that exposes the photoconductive drum;

a conveying unit that conveys a printing sheet to the process cartridge; and a fixing unit that fixes a developer image formed on the printing sheet by the process cartridge.

12. Agitator comprising:

a support shaft having an axis and an axial center; and plural vanes, each having a base connected to the support shaft and defining a connection point on the support shaft axis, a leading edge extending from the base, a trailing edge extending from the base, and an arcuate peripheral edge meeting the leading edge at a first point and the trailing edge at a second point, wherein:

an imaginary plane defined by the connection point, the first point and the second point is non-perpendicular to the support shaft axis; and the second point is located between the first point and the axial center as viewed in a first direction perpendicular to the support shaft axis.

13. The agitator according to claim 12, wherein the plural vanes are arranged symmetrical with respect to the axial center.

14. The agitator according to claim 12, wherein the plural vanes are grouped into a first group disposed between the axial center and one of axial ends of the support shaft and a second group disposed between the axial center and the other of the axial ends of the support shaft, wherein the connection points of the first group vanes are arranged at a constant interval.

15. The agitator according to claim 14, wherein the connection points of the second group vanes are arranged at a constant interval.

16. The agitator according to claim 12, wherein the vanes includes a first vane and a second vane adjacent to the first vane and located between the first vane and axial center, a minimal distance between the first vane and the axial center as viewed in the first direction is smaller than a maximum distance between the second vane and axial center as viewed in the first direction.

17. The agitator according to claim 12, wherein the imaginary plane is oblique in a range of 40 to 60 degrees with respect to the support shaft axis.

18. The agitator according to claim 12, further comprising:

an elastically deformable member having a proximal end fixed with respect to the support shaft and a distal, free end, wherein a distance between the support shaft axis and the distal, free end is larger than a distance between the support shaft axis and the arcuate peripheral edge.

19. The agitator according to claim 12, wherein the first point is located away from the second point at an angular interval of about 90 degrees with respect to the support shaft axis.

* * * * *

UNITED STATES PATENT AND TRADEMARK OFFICE

CERTIFICATE OF CORRECTION

PATENT NO. : 7,829,840 B2
APPLICATION NO. : 12/024452
DATED : November 9, 2010
INVENTOR(S) : Keigo Nakajima It is certified that error appears in the above-identified patent and that said Letters Patent is hereby corrected as shown below:

On the cover page, References Cited item (56), Other Publications:
Please insert --JP OA 2009-03-10, JP Appln. 2007-039566, partial English transition--

In Column 11, Claim 10, Line 64:
Please replace "disposed m the developer" with --disposed in the developer--

Signed and Sealed this
Nineteenth Day of July, 2011

David J. Kappos

David J. Kappos
*Director of the United States Patent and Trademark Office*